US007079967B2

(12) United States Patent
Rossi et al.

(10) Patent No.: US 7,079,967 B2
(45) Date of Patent: Jul. 18, 2006

(54) APPARATUS AND METHOD FOR DETECTING FAULTS AND PROVIDING DIAGNOSTICS IN VAPOR COMPRESSION CYCLE EQUIPMENT

(75) Inventors: Todd M. Rossi, Princeton, NJ (US); Dale Rossi, Limerick, PA (US); Jonathan D. Douglas, Lawrenceville, NJ (US); Timothy P. Stockman, Ivyland, PA (US)

(73) Assignee: Field Diagnostic Services, Inc., Fairless Hills, PA (US)

( * ) Notice: Subject to any disclaimer, the term of this patent is extended or adjusted under 35 U.S.C. 154(b) by 0 days.

(21) Appl. No.: 10/725,774

(22) Filed: Dec. 2, 2003

(65) Prior Publication Data

US 2004/0111239 A1 Jun. 10, 2004

Related U.S. Application Data

(63) Continuation of application No. 09/939,012, filed on Aug. 24, 2001, now Pat. No. 6,658,373.

(60) Provisional application No. 60/313,289, filed on Aug. 17, 2001, provisional application No. 60/290,433, filed on May 11, 2001.

(51) Int. Cl.
*G06F 15/00* (2006.01)
*G06F 11/30* (2006.01)

(52) U.S. Cl. ..... 702/83; 62/127

(58) Field of Classification Search ..... 702/45, 702/47, 50, 55, 98–100, 113, 114, 130, 136, 702/138, 140, 182–185; 62/129; 340/585
See application file for complete search history.

(56) References Cited

U.S. PATENT DOCUMENTS

| | | | | |
|---|---|---|---|---|
| 3,082,951 | A | 3/1963 | Kayan | 703/9 |
| 3,707,851 | A | 1/1973 | McAshan, Jr. | 62/125 |
| 3,736,765 | A | 6/1973 | O'Dell | 62/127 |
| 4,114,448 | A | 9/1978 | Merritt | 73/362 |
| 4,161,106 | A | 7/1979 | Savage et al. | 62/115 |
| 4,186,563 | A | 2/1980 | Schulze, Sr. | 62/126 |
| 4,217,761 | A | 8/1980 | Cornaire et al. | 62/130 |
| 4,325,223 | A | 4/1982 | Cantley | 62/126 |
| 4,381,549 | A | 4/1983 | Stamp, Jr. et al. | 62/126 |
| 4,432,232 | A | 2/1984 | Brantley et al. | 73/865.9 |
| 4,510,576 | A | 4/1985 | MacArthur et al. | 702/182 |
| 4,611,470 | A | 9/1986 | Enström | 62/127 |
| 4,755,957 | A | 7/1988 | White et al. | 702/184 |
| 4,768,346 | A | 9/1988 | Mathur | 62/127 |
| 4,798,055 | A * | 1/1989 | Murray et al. | 62/127 |
| 4,885,914 | A | 12/1989 | Pearman | 62/129 |
| 4,928,278 | A | 5/1990 | Otsuji et al. | 714/700 |
| 4,967,567 | A * | 11/1990 | Proctor et al. | 62/127 |

(Continued)

OTHER PUBLICATIONS

A. E. Dabiri and C. K. Ric, 1981. "A Compressor Simulation Model with Corrections for the Level of Suction Gas Superheat," ASHRAE Transactions, vol. 87, Part 2, pp. 771-782.

(Continued)

*Primary Examiner*—Marc S. Hoff
*Assistant Examiner*—Manuel L. Barbee
(74) *Attorney, Agent, or Firm*—Law Office of Mark Garzia; Mark A. Garzia

(57) ABSTRACT

An apparatus and method for detecting faults and providing diagnostic information in a refrigeration system comprising a microprocessor, a means for inputting information to the microprocessor, a means for outputting information from the microprocessor, and five sensors.

3 Claims, 11 Drawing Sheets

U.S. PATENT DOCUMENTS

| | | | | |
|---|---|---|---|---|
| 5,003,256 | A | 3/1991 | Merrill | 714/814 |
| 5,010,743 | A | 4/1991 | Hale | 62/292 |
| 5,083,438 | A | 1/1992 | McMullin | 62/129 |
| 5,115,643 | A | 5/1992 | Hayata et al. | 62/115 |
| 5,209,076 | A | 5/1993 | Kauffman et al. | 62/126 |
| 5,231,598 | A | 7/1993 | Vlahos | 714/700 |
| 5,239,865 | A | 8/1993 | Salzer et al. | 73/292 |
| 5,596,507 | A * | 1/1997 | Jones et al. | 700/276 |
| 5,623,834 | A | 4/1997 | Bahel et al. | 62/131 |
| 5,666,815 | A | 9/1997 | Aloise | 62/129 |
| 5,746,061 | A | 5/1998 | Kramer | 62/127 |
| 5,760,478 | A | 6/1998 | Bozso et al. | 257/777 |
| 5,934,088 | A | 8/1999 | Takeda | 62/127 |
| 5,991,890 | A | 11/1999 | Brown et al. | 713/503 |
| 6,128,910 | A | 10/2000 | Faircloth | 62/129 |
| 6,223,544 | B1 | 5/2001 | Seem | 62/127 |
| 6,272,868 | B1 | 8/2001 | Grabon et al. | 62/125 |
| 6,324,854 | B1 * | 12/2001 | Jayanth | 62/127 |
| 6,360,551 | B1 | 3/2002 | Renders | 62/127 |
| 6,439,061 | B1 | 8/2002 | Nelson et al. | 73/861.65 |
| 6,560,976 | B1 | 5/2003 | Jayanth | 62/127 |
| 6,601,397 | B1 | 8/2003 | Pham et al. | 62/181 |
| 6,615,594 | B1 | 9/2003 | Jayanth | 62/126 |
| 2002/0170299 | A1 | 11/2002 | Jayanth et al. | 62/126 |
| 2003/0033823 | A1 | 2/2003 | Pham et al. | 62/228.3 |
| 2003/0051490 | A1 | 3/2003 | Jayanth | 62/127 |
| 2003/0115890 | A1 | 6/2003 | Jayanth | 62/126 |

OTHER PUBLICATIONS

Copy from website for iSH North America entitled "Restricted Airflow: A Common Culprit" by John Tomczyk; www.achrnews.com/CDA/ArtcleInformation . . . .

Copy from website for Contracting Business Interactive entitled "Beware of Flter Pressure Drop" by Kevin O'Neill; www.contractingbusiness.com/editorial/serviceonline/. . . .

Copy of article entitled, "Effect of reduced evaporator airflow on the high temperature performance of air conditioners" by Angel G. Rodriguez et al., Elsevier Sciences S.A., Energy and Buildings 24 (1996) 195-201.

Copy from website for iSH North America entitled "Performing Residential A/C Airflow Setup" by Scott Nelmark; www..achrnews.com/CDA/ArtcleInformation. . . .

1999 Standard for Positive Displacement Refrigerant Compressors and Compressor Units; by ARI, Arlington, VA © 1999.

* cited by examiner

APPARATUS AND METHOD FOR DETECTING FAULTS AND PROVIDING DIAGNOSTICS IN VAPOR COMPRESSION CYCLE EQUIPMENT

CROSS REFERENCE TO RELATED APPLICATIONS

The present application is a CON of Ser. No. 09/939,012, filed Jun. 24, 2001, now U.S. Pat. No. 6,658,373 which claims the benefit of U.S. Provisional Application No. 60/290,433 filed May 11, 2001, entitled ESTIMATING THE EFFICIENCY OF A VAPOR COMPRESSION CYCLE; and U.S. Provisional Application No. 60/313,289 filed Aug. 17, 2001, under Express Mail # EJ045546604US, entitled VAPOR COMPRESSION CYCLE FAULT DETECTION AND DIAGNOSTICS in the name of Todd Rossi, Dale Rossi and Jon Douglas.

FIELD OF THE INVENTION

The present invention relates generally to heating/ventilation/air conditioning/refrigeration (HVACR) systems and, more specifically, to detecting faults in a system utilizing a vapor compression cycle under actual operating conditions and providing diagnostics for fixing the detected faults.

BACKGROUND OF THE INVENTION

Air conditioners, refrigerators and heat pumps are all classified as HVACR systems. The most common technology used in all these systems is the vapor compression cycle (often referred to as the refrigeration cycle), which consists of four major components (compressor, expansion device, evaporator, and condenser) connected together via a conduit (preferably copper tubing) to form a closed loop system. The term refrigeration cycle used in this document refers to the vapor compression used in all HVACR systems, not just refrigeration applications.

Light commercial buildings (e.g. strip malls) typically have numerous refrigeration systems located on their rooftops. Since servicing refrigeration systems requires highly skilled technician to maintain their operation, and there are few tools available to quantify performance and provide feedback, many of refrigeration cycles are poorly maintained. Two common degradation problems found in such commercial systems are fouling of the evaporator and/or condenser by dirt and dust, and improper refrigerant charge.

In general, maintenance, diagnosis and repair of refrigeration systems are manual operations. The quality of the service depends almost exclusively upon the skill, motivation and experience of a technician trained in HVACR. Under the best circumstances, such service is time-consuming and hit-or-miss opportunities to repair the under-performing refrigeration system. Accordingly, sometimes professional refrigeration technicians are only called upon after a major failure of the refrigeration system occurs, and not to perform routine maintenance on such systems.

Attempts to automate the diagnostic process of HVACR systems have been made. However, because of the complexity of the HVACR equipment, high equipment cost, or the inability of the refrigeration technician to comprehend and/or properly handle the equipment, such diagnostic systems have not gained wide use.

SUMMARY OF THE INVENTION

The present invention includes an apparatus and a method for fault detection and diagnostics of a refrigeration, air conditioning or heat pump system operating under field conditions. It does so by measuring, for each vapor compression cycle, at least five—and up to nine—system parameters and calculating system performance variables based on the previously measured parameters. Once the performance variables of the system are determined, the present invention provides fault detection to assist a service technician in locating specific problems. It also provides verification of the effectiveness of any procedures performed by the service technician, which ultimately will lead to a prompt repair and may increase the efficiency of the refrigeration cycle.

The present invention is intended to be used with any manufacturer's HVACR equipment, is relatively inexpensive to implement in hardware, and provides both highly accurate fault detection and dependable diagnostic solutions which does not depend on the skill or abilities of a particular service technician.

BRIEF DESCRIPTION OF THE DRAWINGS

The accompanying drawings, which are incorporated in and form a part of the specification, illustrate the embodiments of the present invention and, together with the description, serve to explain the principles of the invention. For the purpose of illustrating the present invention, the drawings show embodiments that are presently preferred; however, the present invention is not limited to the precise arrangements and instrumentalities shown.

In the drawings.

DETAILED DESCRIPTION OF PREFERRED EMBODIMENTS

Figure 1:
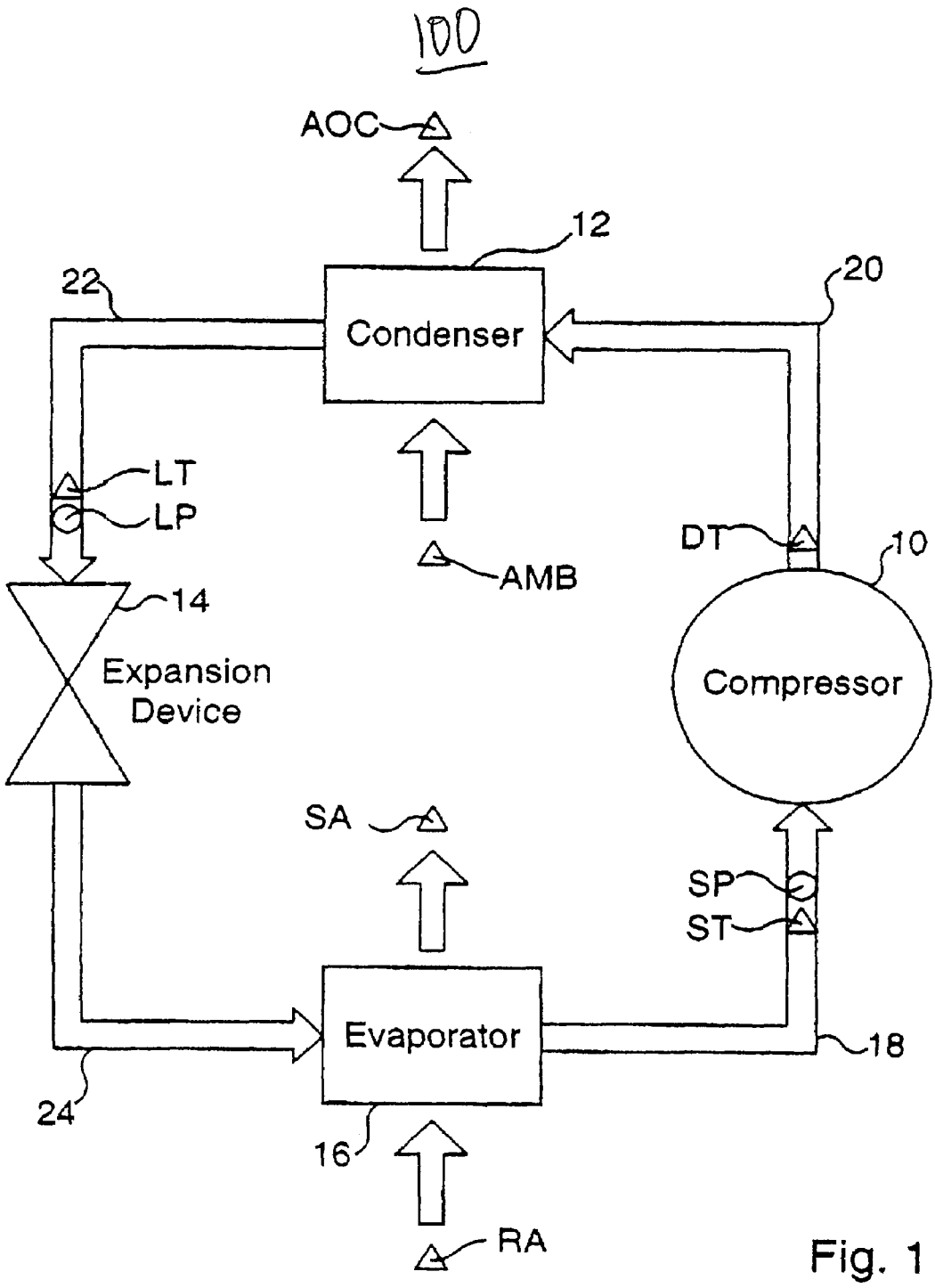
FIG. 1 is a block diagram of a conventional refrigeration cycle.

In describing preferred embodiments of the invention, specific terminology will be selected for the sake of clarity. However, the invention is not intended to be limited to the specific terms so selected, and it is to be understood that each specific term includes all technical equivalents that operate in a similar manner to accomplish a similar purpose.

The terms "refrigeration system" and "HVACR system" are used throughout this document to refer in a broad sense to an apparatus or system utilizing a vapor compression cycle to work on a refrigerant in a closed-loop operation to transport heat. Accordingly, the terms "refrigeration system" and "HVACR system" include refrigerators, freezers, air conditioners, and heat pumps.

Preferred embodiments of the present invention will now be described in detail with reference to the accompanying drawings in which a device used to carry out the method in accordance with the present invention is generally indicated by reference numeral 200. The term "refrigeration cycle" referred to in this document usually refers to systems designed to transfer heat to and from air. These are called direct expansion (evaporator side) air cooled (condenser side) units. It will be understood by those in the art, after reading this description, that another fluid (e.g., water) can be substituted for air with the appropriate modifications to the terminology and heat exchanger descriptions.

The vapor compression cycle is the principle upon which conventional air conditioning systems, heat pumps, and refrigeration systems are able to cool (or heat for heat pumps) and dehumidify air in a defined volume (e.g., a living space, an interior of a vehicle, a freezer, etc.). The vapor-compression cycle is made possible because the refrigerant is a fluid that exhibits specific properties when it is placed under varying pressures and temperatures.

A typical refrigeration system 100 is illustrated in FIG. 1. The refrigeration system 100 is a closed loop system and includes a compressor 10, a condenser 12, an expansion device 14 and an evaporator 16. The various components are connected together via a conduit (usually copper tubing). A refrigerant continuously circulates through the four components via the conduit and will change state, as defined by its properties such as temperature and pressure, while flowing through each of the four components.

The refrigerant is a two-phase vapor-liquid mixture at the required condensing and evaporating temperatures. Some common types of refrigerant include R-12, R-22, R-134A, R-410A, ammonia, carbon dioxide and natural gas. The main operations of a refrigeration system are compression of the refrigerant by the compressor 10, heat rejection by the refrigerant in the condenser 12, throttling of the refrigerant in the expansion device 14, and heat absorption by the refrigerant in the evaporator 16. This process is usually referred to as a vapor compression or refrigeration cycle.

In the vapor compression cycle, the refrigerant nominally enters the compressor 10 as a slightly superheated vapor (its temperature is greater than the saturated temperature at the local pressure) and is compressed to a higher pressure. The compressor 10 includes a motor (usually an electric motor) and provides the energy to create a pressure difference between the suction line and the discharge line and to force a refrigerant to flow from the lower to the higher pressure. The pressure and temperature of the refrigerant increases during the compression step. The pressure of the refrigerant as it enters the compressor is referred to as the suction pressure and the pressure of the refrigerant as it leaves the compressor is referred to as the head or discharge pressure. The refrigerant leaves the compressor as highly superheated vapor and enters the condenser 12.

A typical air-cooled condenser 12 comprises a single or parallel conduits formed into a serpentine-like shape so that a plurality of rows of conduit is formed parallel to each other. Metal fins or other aids are usually attached to the outer surface of the serpentine-shaped conduit in order to increase the transfer of heat between the refrigerant passing through the condenser and the ambient air. Heat is rejected from the refrigerant as it passes through the condenser and the refrigerant nominally exits the condenser as slightly subcooled liquid (its temperature is lower than the saturated temperature at the local pressure). As refrigerant enters a "typical" condenser, the superheated vapor first becomes saturated vapor in the approximately first quarter section of the condenser, and the saturated vapor undergoes a phase change in the remainder of the condenser at approximately constant pressure.

The expansion device 14, or metering device, reduces the pressure of the liquid refrigerant thereby turning it into a saturated liquid-vapor mixture at a lower temperature, to enter the evaporator. This expansion is a throttling process. In order to reduce manufacturing costs, the expansion device is typically a capillary tube or fixed orifice in small or low-cost air conditioning systems and a thermal expansion valve (TXV) or electronic expansion valve (EXV) in larger units. The TXV has a temperature-sensing bulb on the suction line. It uses that temperature information along with the pressure of the refrigerant in the evaporator to modulate (open and close) the valve to try to maintain proper compressor inlet conditions. The temperature of the refrigerant drops below the temperature of the indoor ambient air as it passes through the expansion device. The refrigerant enters the evaporator 16 as a low quality saturated mixture (approximately 20%). ("Quality" is defined as the mass fraction of vapor in the liquid-vapor mixture.)

A direct expansion evaporator 16 physically resembles the serpentine-shaped conduit of the condenser 12. Ideally, the refrigerant completely evaporates by absorbing energy from the defined volume to be cooled (e.g., the interior of a refrigerator). In order to absorb heat from this ambient volume, the temperature of the refrigerant must be lower than that of the volume to be cooled. Nominally, the refrigerant leaves the evaporator as slightly superheated gas at the suction pressure of the compressor and reenters the compressor thereby completing the vapor compression cycle. (It should be noted that the condenser 12 and the evaporator 16 are types of heat exchangers and are sometimes referred to as such in the following text.)

Although not shown in FIG. 1, a fan driven by an electric motor is usually positioned next to the evaporator; a separate fan/motor combination is usually positioned next to the condenser. The fan/motor combinations increase the airflow over their respective evaporator or condenser coils, thereby increasing the transfer of heat. For the evaporator in cooling mode, the heat transfer is from the indoor ambient volume to the refrigerant circulating through the evaporator; for the condenser in cooling mode, the heat transfer is from the refrigerant circulating through the condenser to the outside air. A reversing valve is used by heat pumps operating in heating mode to properly reverse the flow of refrigerant, such that the outside heat exchanger (the condenser in cooling mode) becomes an evaporator and the indoor heat exchanger (the evaporator in cooling mode) becomes a condenser.

Finally, although not shown, is a control system that allows users to operate and adjust the desired temperature within the ambient volume. The most basic control system comprises a low voltage thermostat that is mounted on a wall inside the ambient volume, and relays that control the electric current delivered to the compressor and fan motors. When the temperature in the ambient volume rises above a predetermined value on the thermostat, a switch closes in the thermostat, forcing the relays to make and allowing current to flow to the compressor and the motors of the fan/motors combinations. When the refrigeration system has cooled the air in the ambient volume below the predetermined value set on the thermostat, the switch opens thereby causing the relays to open and turning off the current to the compressor and the motors of the fan/motor combination.

There are common degradation faults in systems that utilize a vapor compression cycle. For example, heat exchanger fouling and improper refrigerant charge both can result in performance degradations including reductions in efficiency and capacity. Low charge can also lead to high superheat at the suction line of the compressor, a lower evaporating temperature at the evaporator, and a high temperature at the compressor discharge. High charge, on the other hand, increases the condensing and evaporating temperature. Degradation faults naturally build up slowly and repairing them is often a balance between the cost of servicing the equipment (e.g., cleaning heat exchangers) and the energy cost savings associated with returning them to optimum (or at least an increase in) efficiency.

The present invention is an effective apparatus and corresponding process for using measurements easily and commonly made in the field to:

1. Detect faults of a unit running in the field;
2. Provide diagnostics that can lead to proper service in the field;
3. Verify the performance improvement after servicing the unit; and
4. Educate the technician on unit performance and diagnostics.

The present invention is useful for:

1. Balancing the costs of service and energy, thereby permitting the owner/operator to make better informed decisions about when the degradation faults significantly impact operating costs such that they require attention or servicing.
2. Verifying the effectiveness of the service carried out by the field technicians to ensure that all services were performed properly.

The present invention is an apparatus and a corresponding method that detects faults and provides diagnostics in refrigeration systems operating in the field. The present invention is preferably carried out by a microprocessor-based system; however, various apparatus, hardware and/or software embodiments may be utilized to carry out the disclosed process.

In effect, the apparatus of the present invention integrates two standard technician hand tools, a mechanical manifold gauge set and a multi-channel digital thermometer, into a single unit, while providing sophisticated user interface implemented in one embodiment by a computer. The computer comprises a microprocessor for performing calculations, a storage unit for storing the necessary programs and data, means for inputting data and means for conveying information to a user/operator. In other embodiments, the computer includes one or more connectors for assisting in the direct transfer of data to another computer that is usually remotely located.

Although any type of computer can be used, a hand-held computer allows portability and aids in the carrying of the diagnostic apparatus to the field where the refrigeration system is located. Therefore, the most common embodiments of a hand-held computer include the Palm Pilot manufactured by 3COM, a Windows CE based unit (for example, one manufactured by Compaq Computers of Houston, Tex.), or a custom computer that comprises the aforementioned elements that can carry out the requisite software instructions. If the computer is a Palm Pilot, the means for inputting data is a serial port that is connected to a data collection unit and the touchpad/keyboard that is standard equipment on a Palm. The means for conveying information to a user/operator is the screen or LCD, which provides written instructions to the user/operator.

Preferably, the apparatus consists of three temperature sensors and two pressure sensors. The two pressure sensors are connected to the unit under test through the suction line and liquid line ports, which are made available by the manufacturer in most units, to measure the suction line pressure SP and the liquid line pressure LP. The connection is made through the standard red and blue hoses, as currently performed by technicians using a standard mechanical manifold. The temperature sensors are thermistors. Two of them measure the suction line temperature ST and the liquid line temperature LT, by attaching them to the outside of the copper pipe at each of these locations, as near as possible to the pressure ports.

A feature of the present invention is that the wires connecting the temperature sensors ST and LT to the data collection unit are attached to the blue and red hoses, respectively, of the manifold. Thus, there is no wire tangling and the correct sensor is easily identified with each hose. The remaining temperature sensor is used to measure the ambient air temperature AMB. These five sensors are easily installed and removed from the unit and do not have to be permanently installed in the preferred embodiment of the invention. This feature allows for the portability of the apparatus, which can be used in multiple units in a given job.

Although these five measurements are sufficient to provide fault detection and diagnostics in the preferred embodiment, four additional temperatures can optionally be used to obtain more detailed performance analysis of the system under consideration. These four additional temperatures are: supply air SA, return air RA, discharge line DT, and air off condenser AOC. All the sensor positions, including the optional, are shown in FIG. 1.

Referring again to FIG. 1, the pressure drop in the tubes connecting the various devices of a vapor compression cycle is commonly regarded as negligible; therefore, the important states of a vapor compression cycle may be described as follows:

State 1: Refrigerant leaving the evaporator and entering the compressor. (The tubing connecting the evaporator and the compressor is called the suction line 18.)

State 2: Refrigerant leaving the compressor and entering the condenser (The tubing connecting the compressor to the condenser is called the discharge or hot gas line 20).

State 3: Refrigerant leaving the condenser and entering the expansion device. (The tubing connecting the condenser and the expansion device is called the liquid line 22).

State 4: Refrigerant leaving the expansion device and entering the evaporator (connected by tubing 24).

Figure 2:
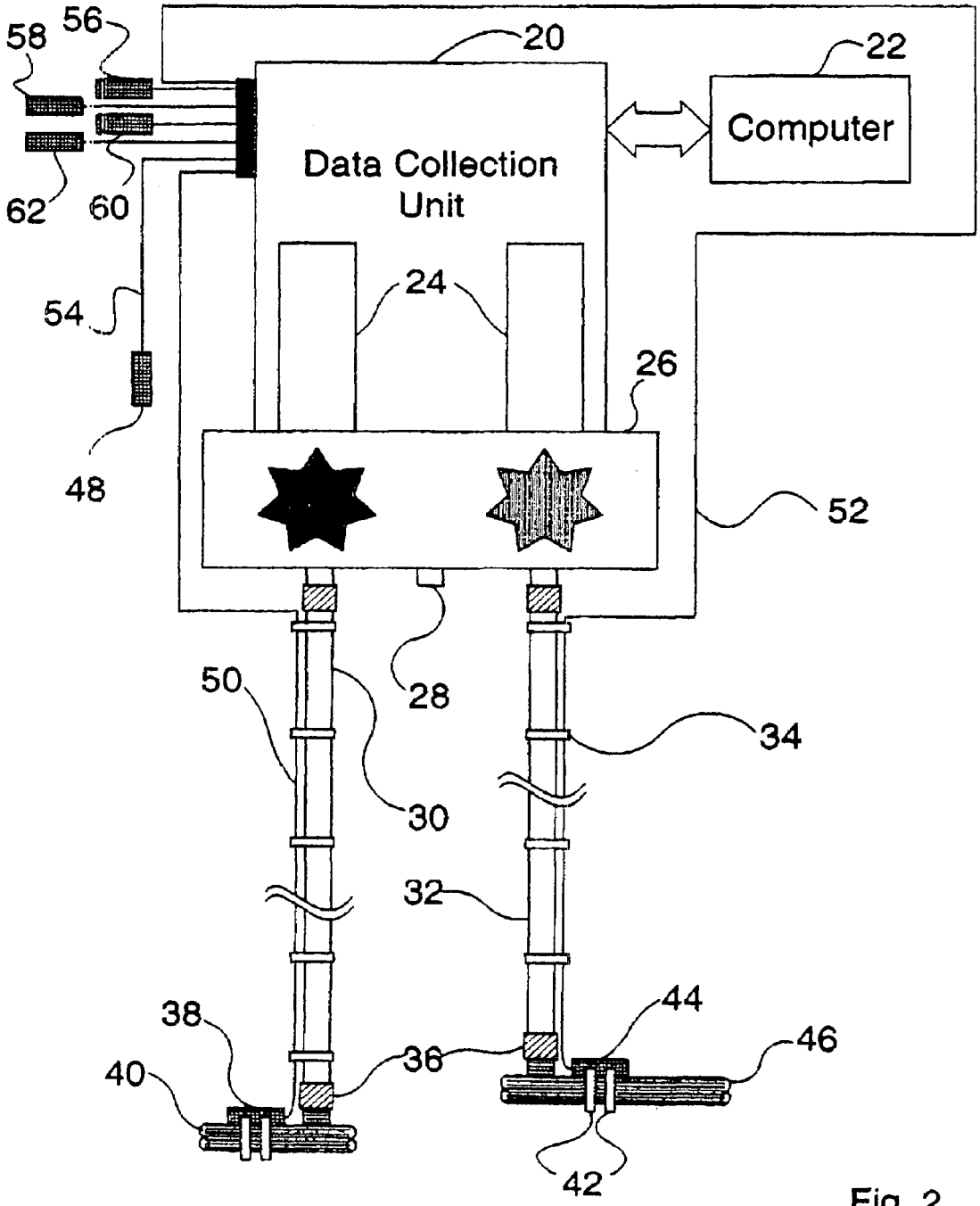
FIG. 2 is a schematic representation of the apparatus in accordance with the present invention.

A schematic representation of the apparatus is shown in FIG. 2. The data collection unit 20 is connected to a computer 22. The two pressure transducers (the left one for suction line pressure SP and the right one for liquid line pressure LP) 24 are housed with the data collection unit 20 in the preferred embodiment. The temperature sensors are connected to the data collection unit through a communication port shown on the left of the data collection unit. The three required temperatures are ambient temperature (AMB) 48, suction line temperature (ST) 38, and liquid line temperature (LT) 44. The optional sensors measure the return air temperature (RA) 56, supply air temperature (SA) 58, discharge temperature (DT) 60, and air off condenser temperature (AOC) 62.

In one embodiment, the computer is a handheld computer, such as a Palm™ OS device and the temperature sensors are thermistors. For a light commercial refrigeration system, the pressure transducers should have an operating range of 0–700 psig and −15–385 psig for the liquid and suction line pressures, respectively. The apparatus can then be used with the newer high pressure refrigerant R-410a as well as with traditional refrigerants such as R-22.

The low-pressure sensor is sensitive to vacuum to allow for use when evacuating the system. Both pressure transducers are connected to a mechanical manifold 26, such as the regular manifolds used by service technicians, to permit adding and removing charge from the system while the apparatus is connected to the unit. Two standard refrigerant flow control valves are available at the manifold for that purpose.

At the bottom of the manifold 26, three access ports are available. As illustrated in FIG. 2, the one on the left is to connect to the suction line typically using a blue hose 30; the one in the middle 28 is connected to a refrigerant bottle for adding charge or to a recovery system for removing charge typically using a yellow hose; and the one on the right is connected to the liquid line through a red hose 32. The three hoses are rated to operate with high pressures, as it is the case when newer refrigerants, such as R-410a, are used. The lengths of the hoses are not shown to scale in FIG. 2. At the end of the pressure hoses, there are pressure ports to connect to the unit pipes 40 and 46, respectively. The wires, 50 and 52 respectively, leading to the suction and liquid line temperature sensors are attached to the respective pressure hoses using wire ties 34 to avoid misplacing the sensors. The suction and liquid line pipes, 40 and 46, respectively, are shown to provide better understanding of the tool's application and are not part of the apparatus. The suction and liquid line temperature sensors, 38 and 44 respectively, are attached to the suction and liquid line pipes using an elastic mounting 42.

Figure 3:
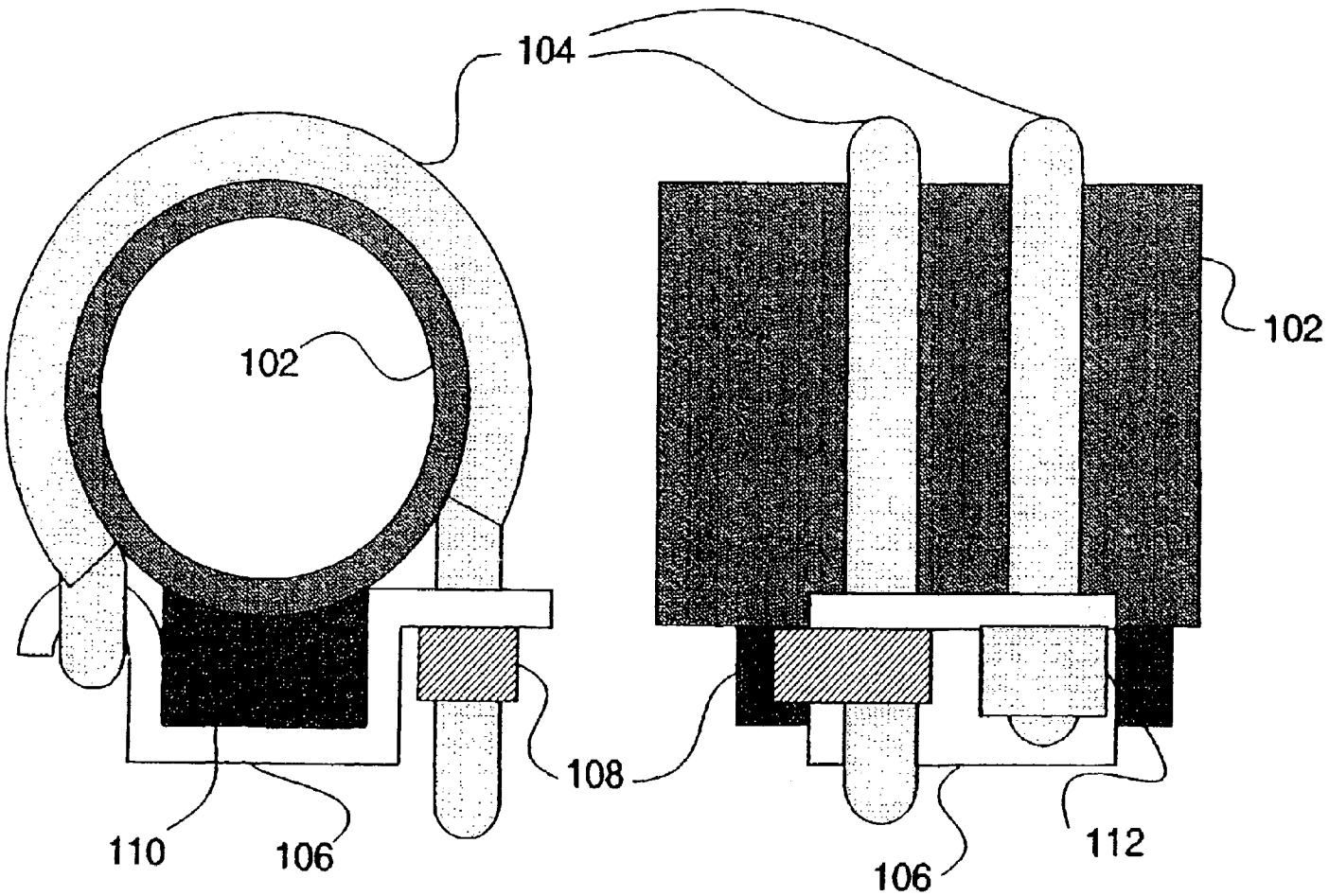
FIG. 3 is a schematic representation of the pipe mounting of the temperature sensors in accordance with the present invention.

The details of the mounting of the temperature sensor on the pipe are shown in FIG. 3. It is assumed that the temperature of the refrigerant flowing through the pipe 102 is equal to the outside temperature of the pipe. Measuring the actual temperature of the refrigerant requires intrusive means, which are not feasible in the field. To measure the outside temperature of the pipe, a temperature sensor (a thermistor) needs to be in good contact with the pipe. The pipes used in HVACR applications vary in diameter. As an alternative, in another embodiment of the present invention, the temperature sensor 110 is securely placed in contact with the pipe using an elastic mounting. An elastic cord 104 is wrapped around the pipe 102, making a loop on the metallic pipe clip 106. A knot or similar device 112 is tied on one end of the elastic cord, secured with a wire tie. On the other end of the elastic cord, a spring loaded cord lock 108 is used to adjust and secure the temperature sensor in place for any given pipe diameter. Alternatively, temperature sensors can be secured in place using pipe clips as it is usually done in the field.

Figure 4:
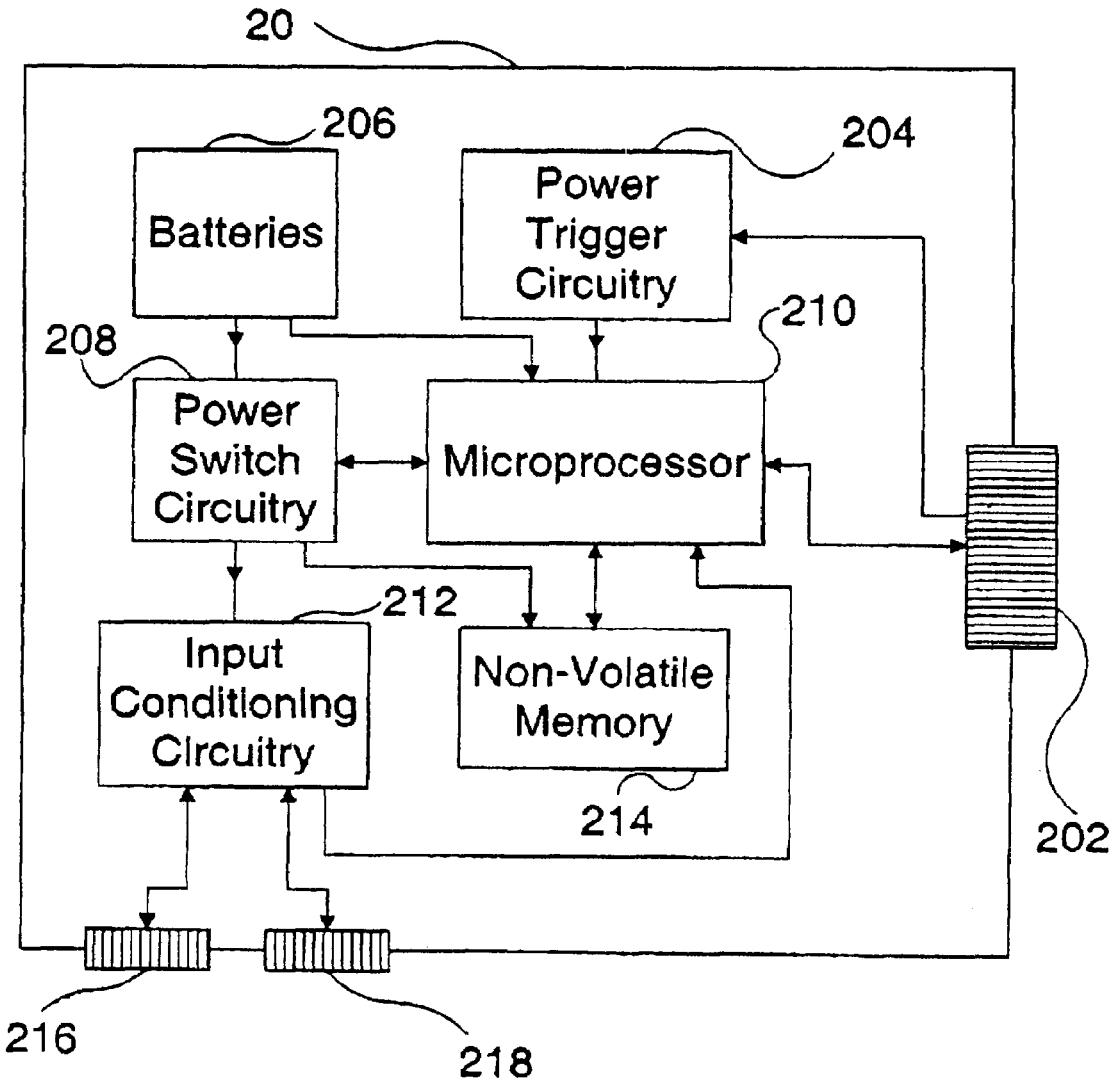
FIG. 4 is a schematic representation of the data collection unit.

Referring now to FIG. 4, the data collection unit 20 comprises a microprocessor 210 and a communication means. The microprocessor 210 controls the actions of the data collection unit, which is powered by the batteries 206. The batteries also serve to provide power to all the parts of the data collection unit and to excite the temperature and pressure sensors. The software is stored in a non-volatile memory (not shown) that is part of the microprocessor 210. A separate non-volatile memory chip 214 is also present. The data collection unit communicates with the handheld computer through a bi-directional communication port 202. In one embodiment, the communication port is a communication cable (e.g., RS232), through the serial communication connector. The temperature sensors are connected to the data collection unit through a port 216, and connectors for pressure transducers 218 are also present. In the preferred embodiment of the invention, the pressure transducers are housed with the data collection unit. Additional circuits are present in the preferred embodiment. Power trigger circuitry 204 responds to the computer to control the process of turning on the power from the batteries. Power switch circuitry 208 controls the power from the batteries to the input. conditioning circuitry 212, the non-volatile memory 214 and the microprocessor 210. Input conditioning circuitry 212 protects the microprocessor from damaging voltage and current from the sensors.

Figure 5:
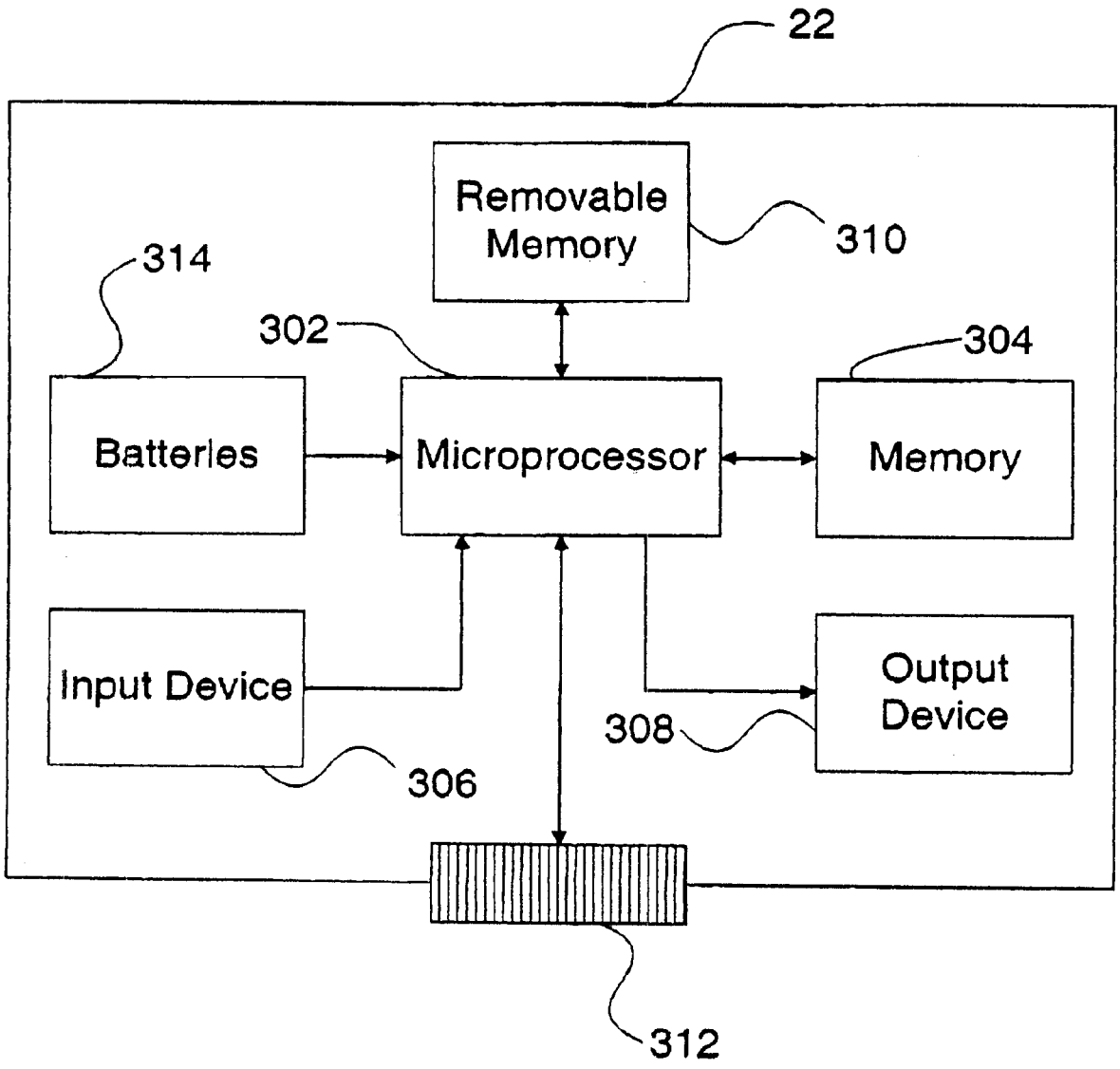
FIG. 5 is a schematic representation of the computer in accordance with the present invention.

A schematic diagram of the computer is shown in FIG. 5. The computer, preferably a handheld device, has a microprocessor 302 that controls all the actions. The software, the data, and all the resulting information and diagnostics are stored in the memory 304. The technician provides information about the unit through an input device (e.g. keyboard or touchpad) 306, and accesses the measurements, calculated parameters, and diagnostics through an output device (e.g. LCD display screen) 308. The computer is powered by a set of batteries 314. A non-volatile removable memory 310 is present to save important data, including the software, in order to restore the important settings in case of power failure.

The invention can be used in units using several refrigerants (R-22, R-12, R-500, R-134a, and R-410a). The computer prompts (through LCD display 308) the technician for the type of refrigerant used by the refrigeration system to be serviced. The technician selects the refrigerant used in the unit to be tested prior to collecting data from the unit. The implementation of a new refrigerant requires only programming the property table in the software. The computer also prompts (again through LCD display 308) the technician for the type of expansion device used by the refrigeration system. The two primary types of expansion devices are fixed orifice or TXV. After the technician has answered both prompts, the fault detection and diagnostic procedure can start.

Figure 6A:
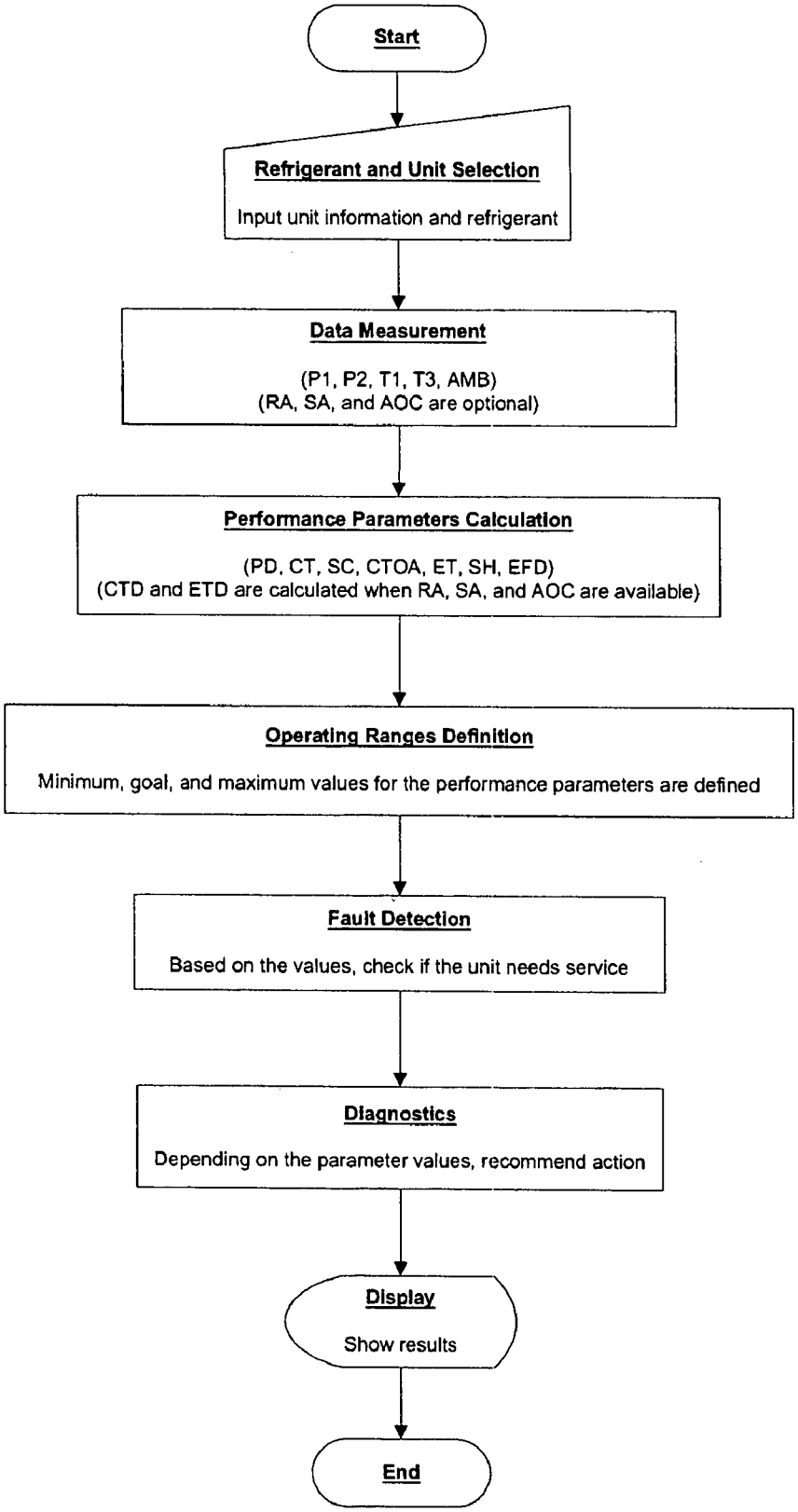
FIGS. 6A–6F form a flow chart of a method for detecting faults and providing diagnostics of a vapor compression cycle in accordance with the present invention.

The process will now be described in detail with respect to a conventional refrigeration cycle. FIG. 6A is a flowchart of the main steps of the present invention utilizing five field measurements. As described above, various gauges and sensors are known to those skilled in the art that are able to take the five measurements. Also, after reading this description, those skilled in the art will understand that more than five measurements may be taken in order to determine the efficiency and the best course of action for improving the efficiency of the refrigeration system.

The method consists of the following steps:

A. Measure high and low side refrigerant pressures (LP and SP, respectively); measure the suction and liquid line temperatures (ST and LT, respectively); and measure the outdoor atmospheric temperature (AMB) used to cool the condenser. These five measurements are all common field measurements that any refrigeration technician can make using currently available equipment (e.g., manifold pressure gauges, thermometers, etc.). If sensors are available, also measure the discharge temperature (DT), the return air temperature (RA), the supply air temperature (SA), and the air off condenser temperature (AOC). These measurements are optional, but they provide additional insight into the performance of the vapor compression cycle. (As stated previously, these are the primary nine measurements—five required, four optional—that are used to determine the performance of the HVAC unit and that will eventually be used to diagnose a problem, if one exists.) Use measurements of LP and LT to accurately calculate liquid line subcooling, as it will be shown in step B.

Use the discharge line access port to measure the discharge pressure DP when the liquid line access port is not available. Even though the pressure drop across the condenser results in an underestimate of subcooling, assume LP is equal to DP or use data provided by the manufacturer to estimate the pressure drop and determine the actual value of LP.

B. Calculate the performance parameters that are necessary for the fault detection and diagnostic algorithm.

B. 1. Use the liquid pressure (LP) and the suction pressure (SP) to calculate the pressure difference (PD), also known as the expansion device pressure drop $$PD=LP-SP.$$

B.2. Use the liquid line temperature (LT), liquid pressure (LP), outdoor air ambient temperature (AMB), and air of condenser temperature (AOC) to determine the following condenser parameters:

B.2.1. the condensing temperature (CT)

$$CT=T_{sat}(LP),$$

B.2.2. the liquid line subcooling (SC)

$$SC=CT-LT,$$

B.2.3. the condensing temperature over ambient (CTOA)

$$CTOA=CT-AMB,$$

B.2.4. the condenser temperature difference (CTD), if AOC is measured $$CTD=AOC-AMB.$$

B.3. Use the suction line temperature (ST), suction pressure (SP), return air temperature (RA), and supply air temperature (SA) to determine:

B.3.1. the evaporating temperature (ET):

$$ET=T_{sat}(SP),$$

B.3.2. the suction line 59*d* superheat (SH):

$$SH=ST-ET$$

B.3.3. the evaporator temperature difference (ETD), if RA and SA are measured:

$$ETD=RA-SA.$$

C. Define the operating ranges for the performance parameters. The operating range for each performance parameter is defined by up to 3 values; minimum, goal, and maximum. Table 1 shows an example of operating limits for some of the performance parameters. The operating ranges for the superheat (SH) are calculated by different means depending upon the type of expansion device. For a fixed orifice unit, use the manufacturer's charging chart and the measurements to determine the manufacturer's suggested superheat. For TXV units the superheat is fixed: for air conditioning applications use 20° F.

TABLE 1

Example of Operating Ranges for Performing Indices

| Symbol | Description | Minimum | Goal | Maximum |
|---|---|---|---|---|
| CTOA (° F.) | Condensing over Ambient Temperature Difference | — | — | 30 |
| ET (° F.) | Evaporating Temperature | 30 | 40 | 47 |

TABLE 1-continued

Example of Operating Ranges for Performing Indices

| Symbol | Description | Minimum | Goal | Maximum |
|---|---|---|---|---|
| PD (psig) | Pressure Difference | 100 | — | |
| SC (° F.) | Liquid Subcooling | 6 | 12 | 20 |
| SH (° F.) | Suction Superheat | 12 | 20 | 30 |
| CTD (° F.) | Condenser Temperature Difference | — | — | 30 |
| ETD (° F.) | Evaporator Temperature Difference | 17 | 20 | 26 |

Note that the values presented illustrate the concept and may vary depending on the actual system investigated.

D. A level is assigned to each performance parameter. Levels are calculated based upon the relationship between performance parameters and the operating range values. The diagnostic routine utilizes the following 4 levels: Low, Below Goal, Above Goal, and High. A performance parameter is High if its value is greater than the maximum operating limit. It is Above Goal if it the value is less than the maximum limit and greater than the goal. The performance parameter is Below Goal if the value is less than the goal but greater than the low limit. Finally, the parameter is Low if the value is less than the minimum.

The following are generally accepted rules, which determine the operating regions for air conditioners, but similar rules can be written for refrigerators and heat pumps:

D.1 The limits for evaporating temperature (ET) define two boundaries: a low value leads to coil freezing and a high value leads to reduced latent cooling capacity.

D.2 The maximum value of the condensing temperature over ambient difference (CTOA) defines another boundary: high values lead to low efficiency. Note that a high value is also supported by high condenser temperature difference (CTD).

D.3 The minimum value of the pressure drop (PD) defines another boundary. A lower value may prevent the TXV from operating properly.

D.4 Within the previously defined boundaries, suction superheat (SH) and liquid subcooling (SC) provides a sense for the amount of refrigerant on the low and high sides, respectively. A high value of suction superheat leads to insufficient cooling of hermetically sealed compressors and a low value allows liquid refrigerant to wash oil away from moving parts inside the compressor. A high or low liquid subcooling by itself is not an operational safety problem, but it is important for diagnostics and providing good operating efficiency. Low SC is often associated with low charge.

E. The fault detection aspect of the present invention determines whether or not service is required, but does not specify a particular action. Faults are detected based upon a logic tree using the levels assigned to each performance parameter. If the following conditions are satisfied, the cycle does not need service:

E.1 Condenser temperature (CT) is within the limits as determined by:

E.1.1 The cycle pressure difference (PD) is not low.

E.1.2 The condensing temperature over ambient (CTOA) is not high.

E.1.3 The condenser temperature difference (CTD) is not high

E.2 Evaporator temperature (ET) is neither low nor high.

E.3 Compressor is protected. This means the suction line superheat (SH) is within neither low nor high.

If any of these performance criteria is not satisfied, there must be a well define course of action to fix the problem F. Similar to the fault detection procedure, diagnoses are made upon a logic tree using the levels assigned to each performance parameter. The diagnostic procedure first checks to make sure that the condensing and evaporating temperatures are within their limits (neither Hi or Low). If these criteria are satisfied, then suction line superheat (SH) is checked.

F.1 Check for cool condenser—A cool condenser is not a problem in itself until it causes the pressure difference across the expansion valve to drop below the minimum value required for proper TXV operation. This condition generally happens during low ambient conditions when special controls are needed to reduce the condensing capacity. An inefficient or improperly unloaded compressor can also cause the low-pressure difference.

Figure 6B:
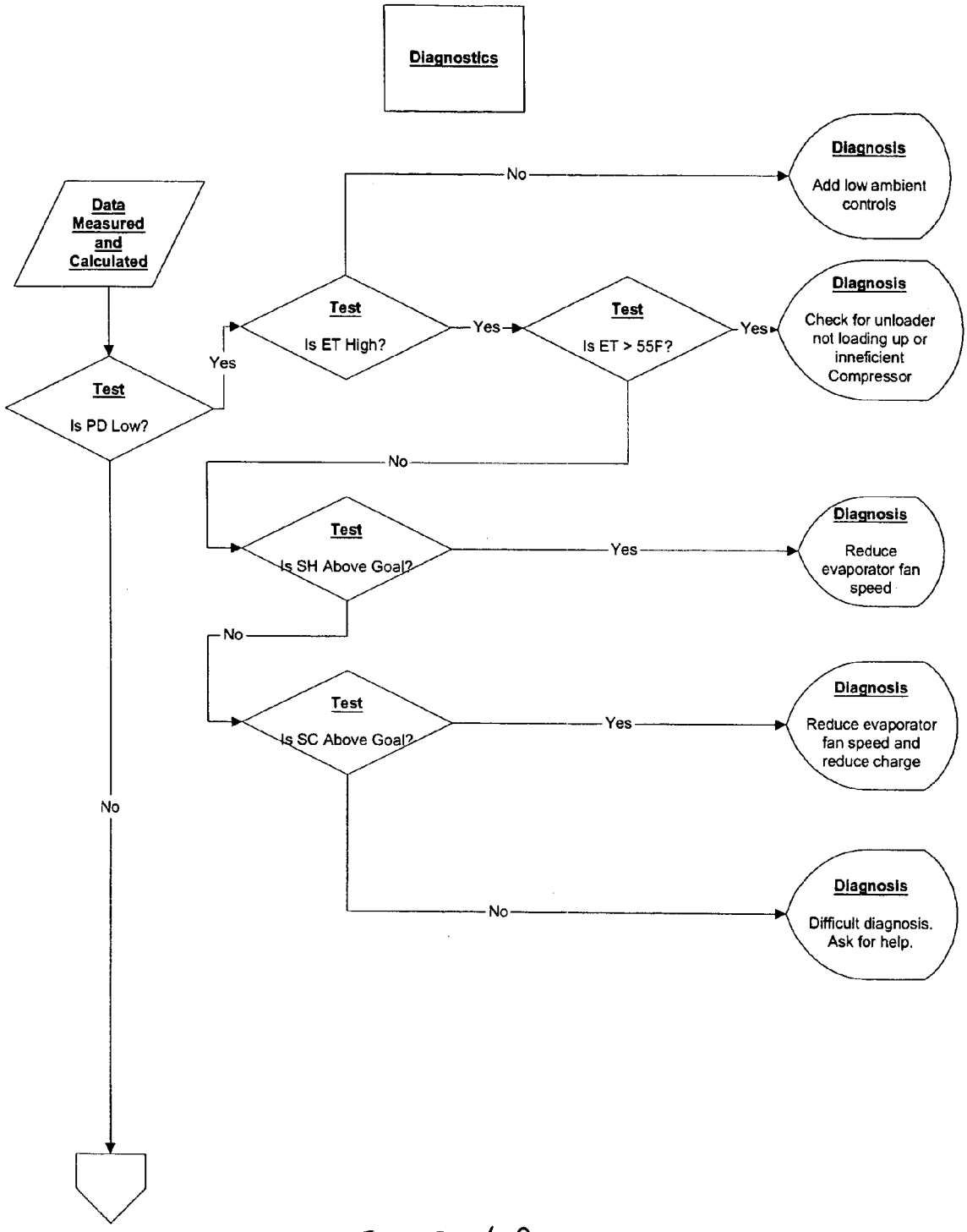

Referring now to FIG. 6B, the evaporating temperature is used to distinguish between these two faults according to the flowing algorithm:

```
If (PD is Low)
    If (ET is High)
        If (ET is Greater than High Limit + 8°F)
            Check for unloader not loading up or
            inefficient compressor.
        else (i.e., ET less than high limit +8°F)
            If (SH is Above Goal)
                Reduce evaporator fan speed.
            else
                If (SC is Above Goal)
                    Reduce evaporator fan
                    speed and reduce charge.
                else (i.e., if ET, SC Below Goal)
                    Difficult diagnosis. Ask for
                    help.
    else (i.e., if ET is not High)
        Add low ambient controls if unit normally
        operates under these conditions.
```

Figure 6C:
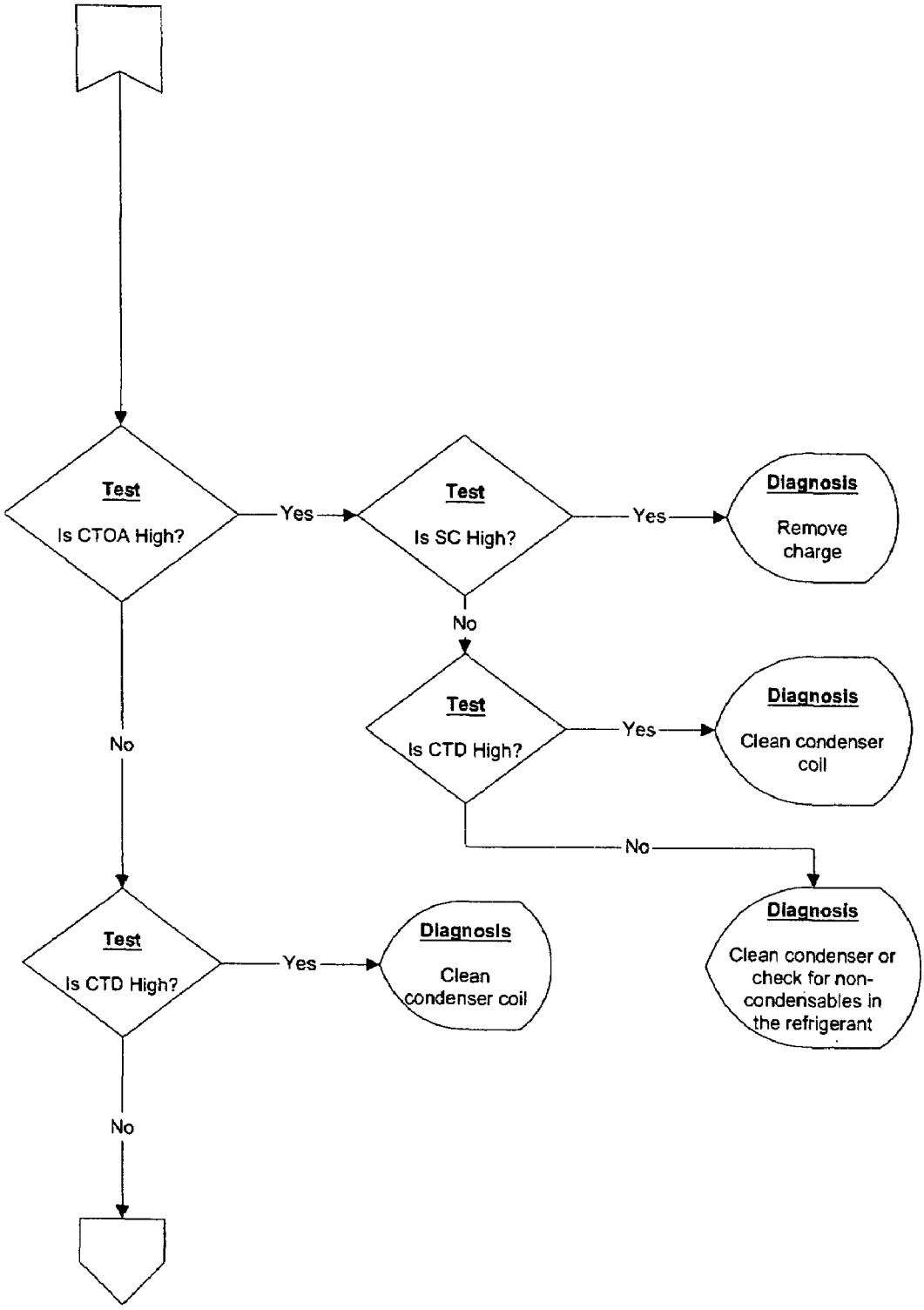

F.2 Check for warm condenser—A warm high side relative to the outdoor ambient temperature is indicated by a high CTOA. Three faults can cause this symptom: high charge, dirty condenser coil, or non-condensable gases in the refrigerant. Referring now to FIG. 6C, SC and CTD are used to identify the fault from among these possibilities using the following rule: If (CTOA is High)

```
If (CTOA is High)
    If (SC is High)
        Remove charge.
    else
        If (CTD is High)
            Clean condenser coil.
        else
            Clean condenser coil or check for non-
            condensables in the refrigerant.
```

Dirty condenser coils is the only fault that causes CTD to become High. If CTD is not available because AOC is not measured, the diagnosis can be either of the last two. Even if CTOA has not exceeded the high limit, High CTD is a compelling reason to clean the condenser coil, leading to this rule:

if (CTD is High) Clean condenser coil.

Figure 6D:
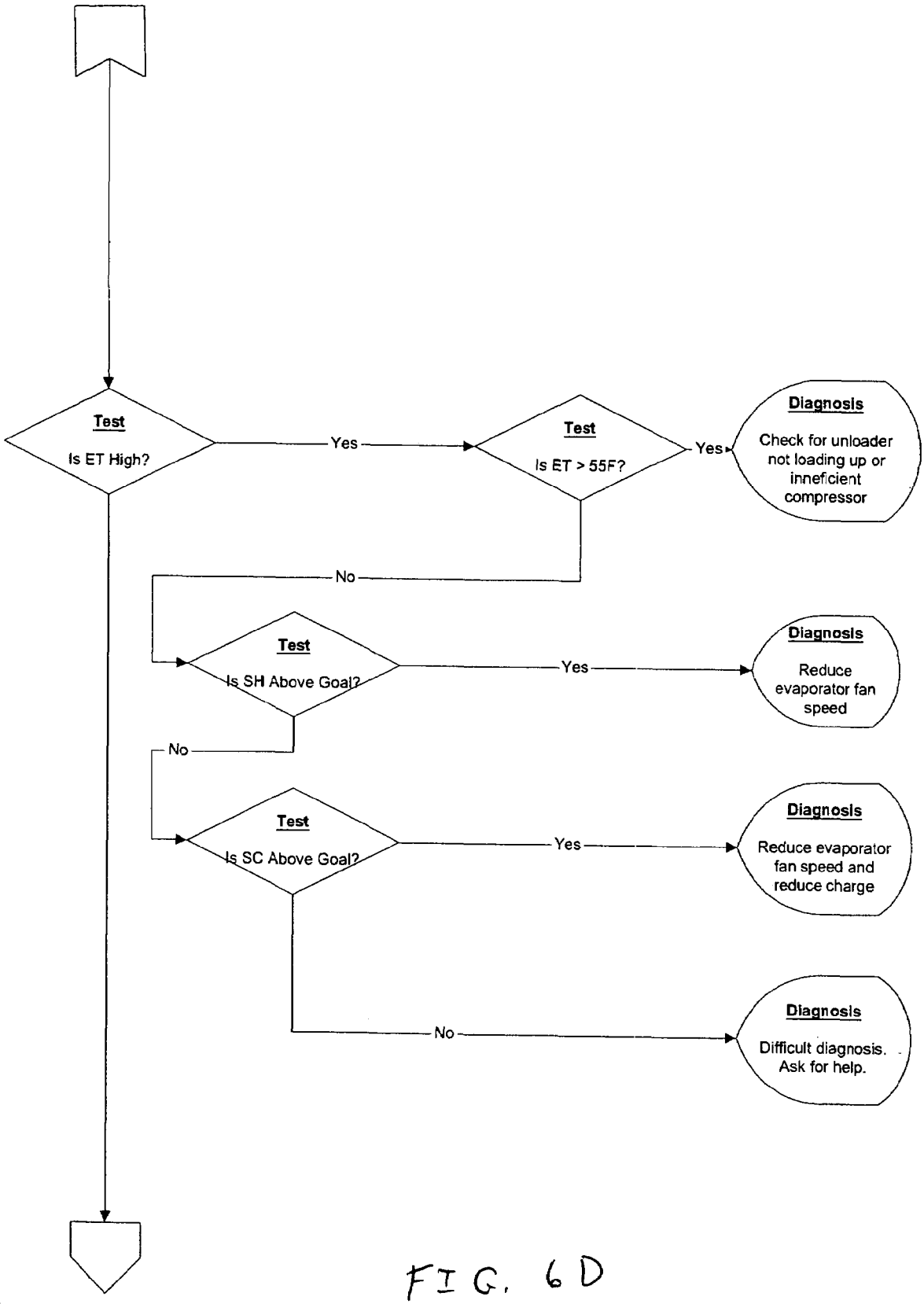

Referring now to FIG. 6D:

F. 3 Check for a warm evaporator If (ET is High)

```
If (ET is High)
    If (ET is Greater than High Limit + 8F)
        Check for unloader not loading up or inefficient
        compressor.
    else
        If (SH is Above Goal)
            Reduce evaporator fan speed.
        else
            If (SC is Above Goal)
                Reduce evaporator fan speed and
                reduce charge.
            else
                Difficult diagnosis. Ask for help.
```

Figure 6E:
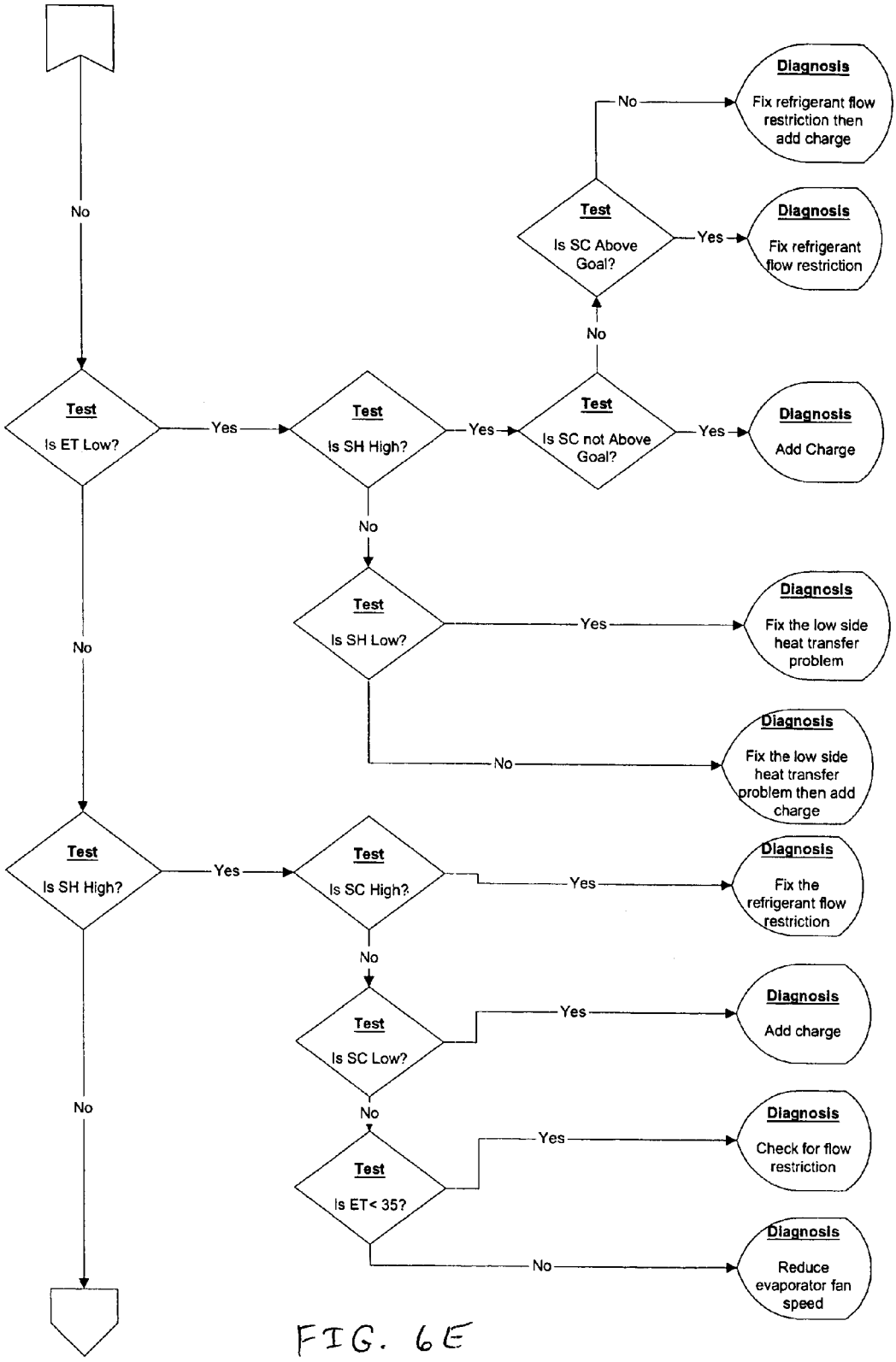

F. 4 Check for a cool evaporator—There are three faults that cause ET to become Low: low charge, refrigerant flow restriction, and a low side heat transfer problem. Referring now to FIG. 6E, using SH and SC distinguish them in this rule:

```
If (ET is Low)
    If (SH is High)
        If (SC is Low)
            Add charge.
        else
            If (SC is Above Goal)
                Fix refrigerant flow restriction. - A
                flow restriction in the liquid line or
                expansion device allows the
                compressor to pump the refrigerant
                out of the evaporator and into the
                condenser. This causes the low side
                pressure, and the ET, to go down. In
                the limit of completely blocked flow,
                the compressor will pump the low
                side into a vacuum. The resulting
                low refrigerant flow rate makes the
                heat exchangers relatively large.
                This causes High SC and High SH as
                the exiting refrigerant depart from its
                saturation condition to the outdoor
                ambient (return air temperature) in
                the condenser (evaporator),
                respectively.
            else
                Fix refrigerant flow restriction
                then add charge - Both refrigerant
                flow restriction and low charge
                contributes to ET Low and SH High.
                SC is OK because removing charge
                has compensated for the High SC,
                usually associated with the
                refrigerant flow restriction.
    else
        If (SH is Low)
            Fix the low side heat transfer problem. -
            When the evaporator can not absorb heat
            properly, ET becomes Low to create a
            higher temperature difference between the
            evaporator and the return air. This helps
            encourage more heat transfer. Since the
            refrigerant is having trouble absorbing heat,
            it is not being superheated sufficiently.
        else
            Fix the low side heat transfer problem
            then add charge. - As the evaporator fouls,
            SH becomes Low which has been
```

-continued compensated for by removing charge. Both of these faults contribute to Low ET.

Figure 6F:
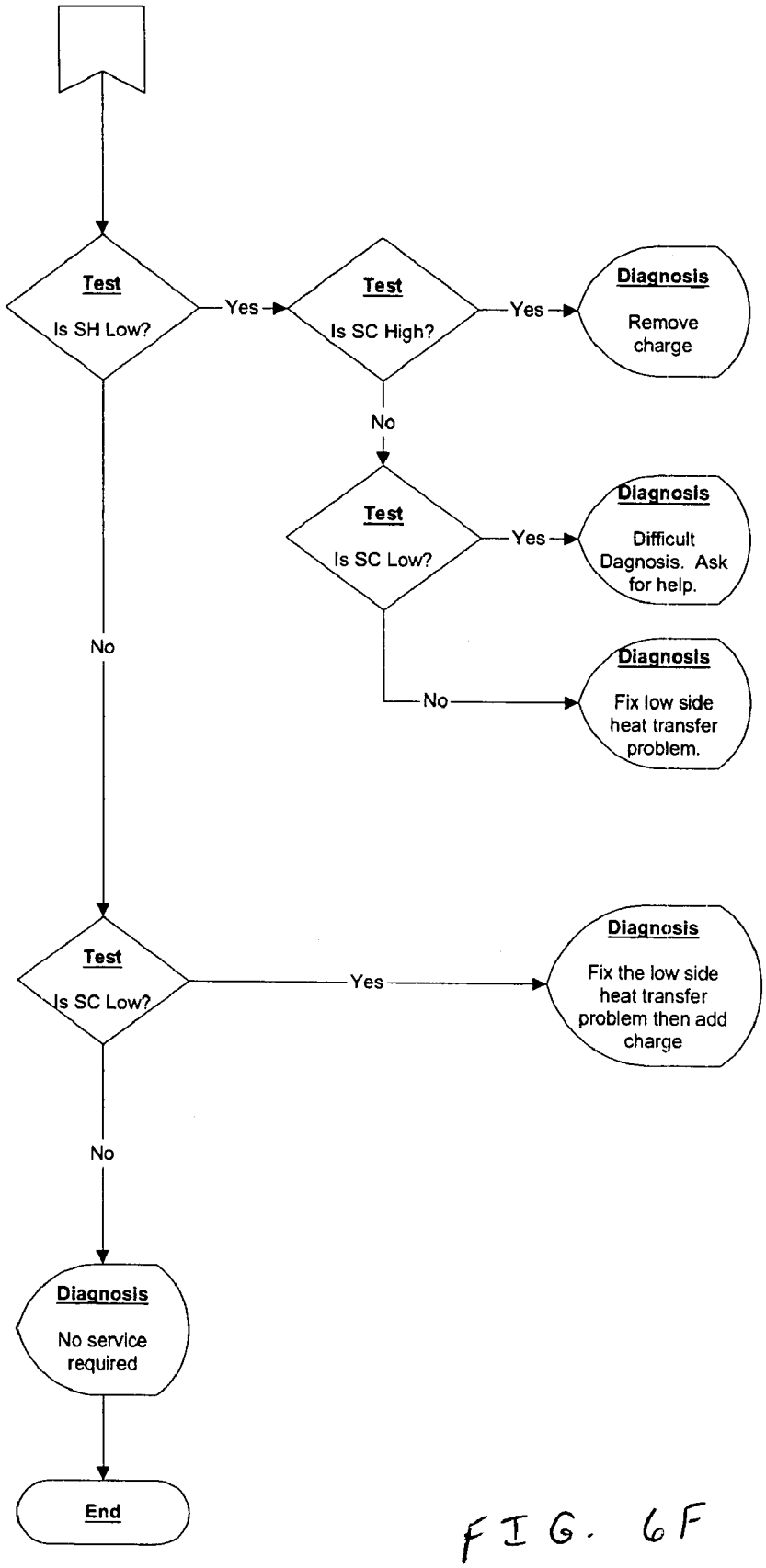

Continuing to refer to FIG. 6F:

F.5 Check if SH is High If(SH is High) If (SH is High) If (SC is High)

```
If (SH is High)
    If (SC is High)
        Fix the refrigerant flow restriction.
    else
        If (SC is Low)
            Add charge. - Adding charge brings the
            High SH and Low SC into line.
            This adjustment brings up CTOA. The
            cycle may run into the High CTOA
            boundary before the High SH and Low SC
            comes into line. The diagnosis will change
            to dirty condenser or non-condensables
            depending on CTD. If this happens, low
            charge is masking one of these problems.
            This adjustment brings up ET. The cycle
            may run into the High ET boundary. The
            diagnosis will change to inefficient
            compressor or unloader needs to load up. If
            this happens, low charge is masking the
            inefficient compressor/unloader problem.
        else
            Reduce evaporator fan speed. - Slowing
            down the evaporator fan brings the High SH
            into line. This adjustment also lowers ET.
            The cycle may run into the Low ET wall
            before SH is OK. Lowering the fan speed
            tends to drive up SC, which is already OK.
            The resulting Low ET, High SH, and OK-
            High SC will indicate that a refrigerant flow
            restriction will have to be repaired to bring
            the cycle off the Low ET boundary.
```

Referring now to FIG. 6F:

F. 6 Check if SH is Low If (SH is Low) If(SC is High)

```
If (SH is Low)
If (SC is High)
    Remove charge. - Removing charge brings the
    Low SH arid High SC into line.
    This adjustment brings down CTOA. The cycle
    may run into the Low PD wall before the Low SH
    and High SC comes into line. The diagnosis will
    change to dirty condenser or non-condensables
    depending on CTD. If this happens, low charge is
    masking one of these problems.
    This adjustment brings up ET. The cycle may run
    into the High ET wall. The diagnosis will change to
    inefficient compressor or unloader needs to load up.
    If this happens, low charge is masking the
    inefficient compressor/unloader problem.
else
    If (SC is Low)
        Difficult diagnosis. Ask for help.
    else
        Fix the low side heat transfer problem.
```

F.7 Check for derated unit If(SH is OK and SC is Low)

Fix the low side heat transfer problem then add charge.—As the evaporator fouls, SH becomes Low which has been compensated for by removing charge. The unit is running safely, but its capacity is reduced.

Although the preferred embodiment of the present invention requires measuring three temperatures and two pressures, one skilled in the art will recognize that the two pressure measurements may be substituted by measuring the evaporating temperature (ET) and the condensing temperature (CT). The suction line pressure (SP) and the liquid line pressure (LP) can be calculated as the saturation pressures at the evaporating temperature (ET) and at the condensing temperature (CT), respectively.

Although this invention has been described and illustrated by reference to specific embodiments, it will be apparent to those skilled in the art that various changes and modifications may be made that clearly fall within the scope of this invention. The present invention is intended to be protected broadly within the spirit and scope of the appended claims.

We claim:

1. A method of providing diagnostics of a refrigeration system, the refrigeration system including a compressor, a condenser, an expansion device, and an evaporator connected together, the method comprising:

determining the type of expansion device used in the refrigeration system;

storing a plurality of HVAC system parameters that have been pre-defined for a particular refrigeration system and type of expansion device used;

defining a plurality of diagnostic messages based on said particular refrigeration system;

measuring at least five but not more than nine HVAC system variables;

calculating various HVAC operational variables including superheat based on the measurement of said at least five HVAC system variables;

comparing the calculated HVAC operational variables to said stored HVAC system parameters; and conveying at least one of said plurality of diagnostic messages to a person performing said diagnostics;

wherein if it is determined during said determining step that said expansion device is a thermal expansion valve, the superheat is fixed at 20 ° F.

2. The method of claim 1 wherein said comparison step includes the assignment of a level based upon the relationship between said calculated HVAC operational variables and said stored HVAC system parameters.

3. The method of claim 2 wherein said levels assigned are "LOW", "BELOW GOAL", "ABOVE GOAL", and "HIGH", wherein a performance parameter is HIGH if its value is greater than the maximum operating limit; a performance parameter is ABOVE GOAL if its value is less than the maximum limit and greater than the goal; a performance parameter is BELOW GOAL if its value is less than the goal but greater than the low limit; and a performance parameter is LOW if its value is less than the low limit.

* * * * *